US005547008A

United States Patent [19]

Sullivan

[11] Patent Number: 5,547,008

[45] Date of Patent: Aug. 20, 1996

[54] MINI BLIND AND VERTICAL BLIND ACTUATOR

[76] Inventor: Kenneth J. Sullivan, 242 E. High St., Avon, Mass. 02322

[21] Appl. No.: 382,758

[22] Filed: Feb. 2, 1995

[51] Int. Cl.[6] ..... E06B 9/26

[52] U.S. Cl. ..... 160/176.1; 160/DIG. 17

[58] Field of Search ..... 160/176.1 P, 168.1 P, 160/331, DIG. 17, 84.02, 176.1 R, 177 R, 321

[56] References Cited

U.S. PATENT DOCUMENTS

| | | | |
|---|---|---|---|
| 2,788,481 | 4/1957 | Lui et al. | 160/331 X |
| 3,269,454 | 8/1966 | Gill et al. | 160/331 |
| 3,308,873 | 3/1967 | Dotto | 160/176 |
| 3,310,099 | 3/1967 | Hunter et al. | 160/171 |
| 3,438,423 | 4/1969 | Melull et al. | 160/331 |
| 3,561,520 | 2/1971 | Gill | 160/331 |
| 3,633,646 | 1/1972 | Zilver | 160/176.1 R X |
| 4,550,759 | 11/1985 | Archer | 160/DIG. 17 X |
| 4,644,990 | 2/1987 | Webb et al. | 160/176.1 P A |
| 4,775,039 | 10/1988 | Onosato et al. | 160/331 |
| 4,896,713 | 1/1990 | Rademacher | 160/168.1 P |
| 4,902,953 | 2/1990 | Kraft et al. | 318/663 |
| 4,913,214 | 4/1990 | Ming | 160/168.1 P |
| 4,956,588 | 9/1990 | Ming | 160/331 X |
| 4,979,550 | 12/1990 | Long et al. | 160/5 |
| 4,993,469 | 2/1991 | Moench | 160/168.1 |
| 4,995,442 | 2/1991 | Marzec | 160/331 |
| 5,175,478 | 12/1992 | Chen | 160/DIG. 17 X |
| 5,186,229 | 2/1993 | Hsu | 160/177 R |
| 5,391,967 | 2/1995 | Domel et al. | 160/176.1 P X |

FOREIGN PATENT DOCUMENTS

| | | | |
|---|---|---|---|
| 2164986 | 4/1986 | United Kingdom | 160/178.1 |

*Primary Examiner*—David M. Purol
*Attorney, Agent, or Firm*—Joseph H. McGlynn

[57] ABSTRACT

A universal motorized window blind system having a motor with an output shaft operatively attached to a mechanism for opening and closing horizontal mini blinds, and having adjustable limit switches to control the amount the blinds are opened or closed, and a hollow tube is connected at one end to the output shaft of the motor and connected at the other end to the mechanism for opening and closing the blinds. In a second embodiment a motorized system for opening and closing vertical blinds has adjustable limit switches to control the amount the blinds are opened or closed, and a wheel attached to the output shaft of the motor and the usual flexible endless loop of material for opening and closing the vertical blinds is looped around the wheel.

7 Claims, 2 Drawing Sheets

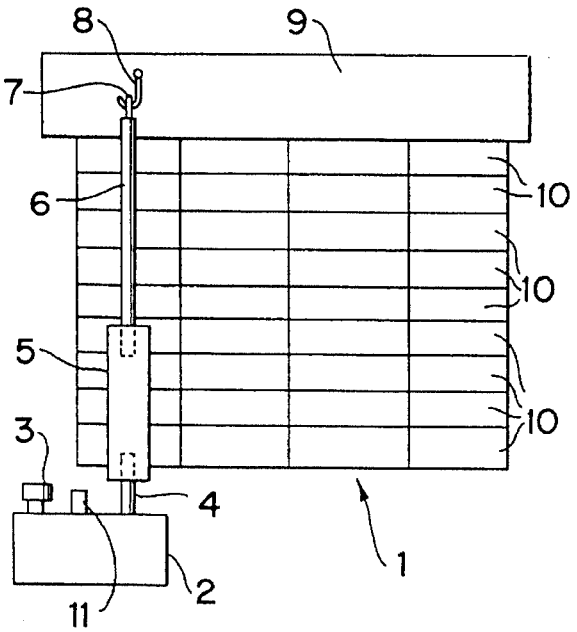
FIG. 1
FIG. 2
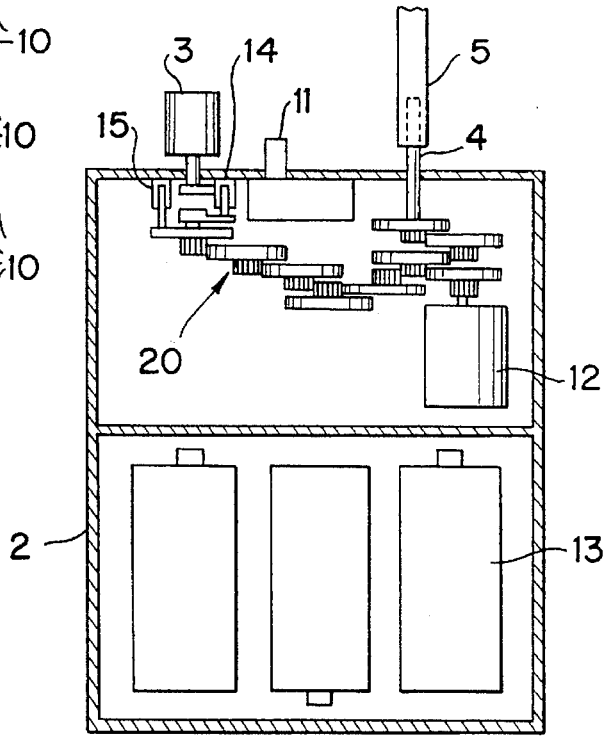
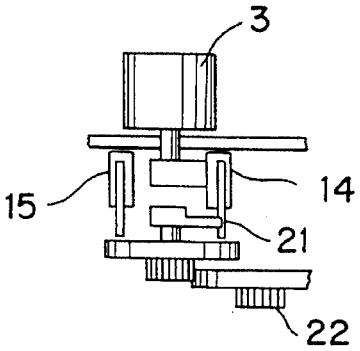
FIG. 3
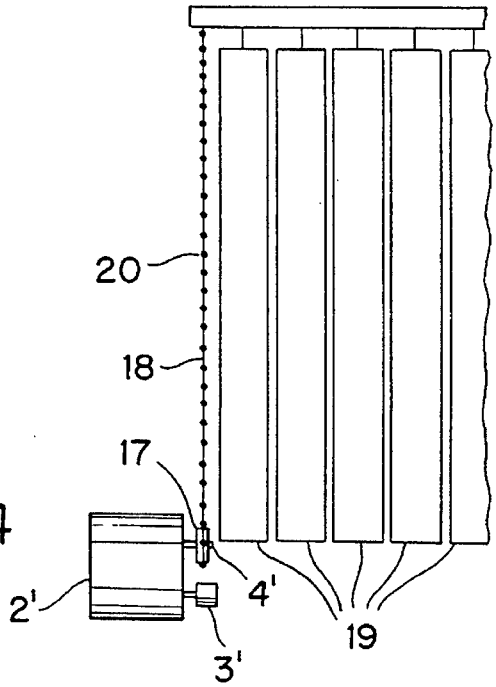
FIG. 4

MINI BLIND AND VERTICAL BLIND ACTUATOR

BACKGROUND OF THE INVENTION

This invention relates in general to a means for discriminatingly moving adjustable mini blind or vertical blind slats from an open to a closed position, and more particularly relates to a mechanism that can be attached to the slat adjustment wand, either onto an existing wand or onto as they are being manufactured, or to the adjusting means on a vertical blind in order to connect an electrical or mechanical operator.

DESCRIPTION OF THE PRIOR ART

In the prior art motors have been connected to blinds so they could be opened or closed by manual actuation or by automatic operators such as a switch or photocell. However all of the prior art mechanisms have been designed to replace the normal operators that come installed on the blinds. This causes an increase in the cost and, also, makes it impractical for the normal homeowner to install himself. This requires a trained service man to install the devices, which, again, raises the cost of such devices.

SUMMARY OF THE INVENTION

The present invention utilizes a section of plastic tubing or other suitable material which is connected on one end to the motor or other mechanical device which operates the blinds, and on the other end to the wand or chain which comes installed on the blinds. The tubing can also be made longer and connected directly to the blind, thereby eliminating the wand.

It is an object of the present invention to provide a simple and economical means whereby a mini blind or vertical blind can be attached to a motor or other operating means.

It is also an object of this invention to provide a means that can be installed by someone other than a trained service man.

It is also an object of the present invention to provide a means that can be attached directly to the blind mechanism, thereby eliminating the normal operating mechanism such as the control wand.

It is also an object of the present invention to provide a means that can be attached directly to the actuator cord of a vertical blind.

These and other objects and advantages of the present invention will be fully apparent from the following description, when taken in connection with the annexed drawings.

BRIEF DESCRIPTION OF THE DRAWINGS

FIG. 1 shows a mini blind having the tube attached between the wand and a motor.

FIG. 2 is an internal view of the motor housing showing a battery compartment with batteries for operating the motor.

FIG. 3 is a partial view of the limit switches and the gears that control how much the blind will open or close.

FIG. 4 is a view of a motor attached to a vertical blind.

DESCRIPTION OF THE PREFERRED EMBODIMENT

Figure 5:
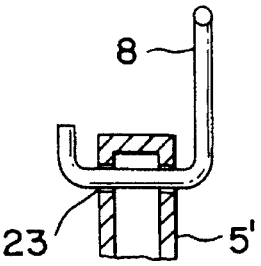
FIG. 5 is a second embodiment showing a different means of attaching the tubing to the blind.

FIG. 1 shows a mini blind installation 1 having a head rail 9, which houses the conventional mechanism for opening and closing the blind, horizontal mini slats 10, and the normal wand 6 which opens and closes the slats 10 that make up the blind. At the top of the blind is a hook 8 to which the wand 6 is attached and which operates the normal opening and closing mechanism of the blind.

Attached to the bottom of the wand 6 is a piece of tubing 5. The other end of tube 5 is attached to the shaft 4 of a reversible motor 12 (shown in FIG. 2). Element 3 is an adjuster knob which is attached to a control for a limit switch and will be described below. Element 11 is a mode selector the operation of which will be also described below.

The tube 5 can be attached to the wand 6 in a variety of ways, for example by a friction fit between the wand and the tube (as shown in FIG. 1 the fit between the tube 5 and the wand 6 and the shaft 4 is shown enlarged for clarity). The tube could also be made from a heat shrink material with an inside diameter larger than the outside diameter of the wand. When the tube is placed on the wand and heated. It will shrink and thereby firmly grasp the outside of the wand as it shrinks. Also, the tube could be made from a rigid material, fitted over the wand and attached to the wand by a screw or cotter pin. It should be noted that the above are merely examples and any known method of attaching the wand to the tube can be used without departing from the scope of the present invention.

Also, the tube 5 can be made from a material that is somewhat flexible so there is some leeway in the placement of the motor housing with respect to the blind system, i.e., the motor housing does not have to be placed directly under the wand as shown in FIG. 1. It could be placed in any convenient location and the tube will bend as necessary to attach to the wand 6. However the tube must also be rigid enough so it will transfer rotational force from the output shaft of the motor to the wand 6 without twisting.

Also, in FIG. 2, batteries 13 are shown as operating a DC motor 12. This is merely for illustration purposes, and it should be understood the motor could be operated by any known means. For example the motor 12 could be an AC motor and directly connected to the AC wiring in a home or office. Also, the motor could be connected to solar cells which would convert sunlight to electrical energy to operate the motor.

Also, the manner of turning the motor 12 on and off could be a variety of means such as, but not limited to, a switch, a solar sensor or a remote control. All of these devices are known in the prior art, and these or any other well known operator could be used without departing from the spirit of the present invention.

Within the motor housing 2 is a motor 12 which is connected by means of a series of gears 20 to a pair of limit switches 14 and 15 (shown in FIG. 3). Switch 15 is a fixed switch and switch 14 is a movable switch, the movement of which is controlled by adjustment knob 3. Turning the knob 3 in one direction moves switch 14 further away from limit switch 15. Turning the knob 3 in the other direction moves switch 14 closer to limit switch 15. Knob 3 does not have to be a rotary knob. It can also be a linear slide that moves switch 14 closer or further away from switch 15. This will allow the user to control the amount the blinds will open or close. The last gears 22 in the series of gears 20 are arranged in approximately a 10 to 1 gear ratio with respect to shaft 4 to allow up to 10 turns of the wand 6, however it should be understood that this ratio is not critical to the invention and will depend on various factors such as the size and type of the motor used. Any ratio that will perform the intended function could be used.

When the motor is activated, the gear chain 20 will start to move thereby turning shaft 4 on the motor which is connected to tubing 5. In order to limit the amount the motor will turn the tubing, switches 15 and 14 are utilized. As the motor turns, arm 21 will rotate toward 15. When arm 21 engages switch 15 the motor will be turned off. Therefore, the distance the switch will have to travel before it engages switch 15 will determine how many turns the wand 6 will travel through, and this will determine how far the blinds will be opened or closed. The switch 14 will determine the distance the blinds will open and the switch 15 will determine the distance the blinds will travel in order to close, depending on the direction of rotation of motor 12. When the arm 21 engages either 14 or 15, the motor 12 will turn off. A multi-position switch 11 is used to manually select open, close, automatic, or any other desired function.

Figure 6:
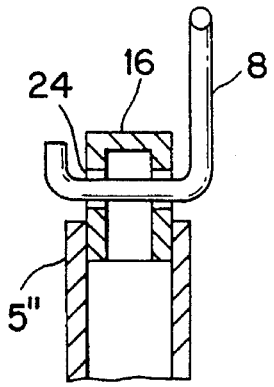
FIG. 6 is another embodiment showing a different attachment between the tubing and the blind.

In the embodiments shown in FIGS. 5 and 6 different means for attaching the tube to the standard mechanism for operating the blinds are shown. These allow the tube to be directly attached to the opening and closing mechanism, thereby eliminating the need for the wand 6. In FIG. 5 at least one aperture 23 is placed in the tube 5' near the top of the tube. The hook 8, which is normally attached to the wand 6 can be directly attached to the tube 5' by placing the hook through at least one of the apertures 23. In all other respects the actuator will operate in the same manner as in the FIG. 1 device.

In FIG. 6, a plug 16, which can be made from but is not limited to, a material such as wood or plastic is placed inside the top of the tube 5". At least one aperture 24 is placed in the plug and cooperates with the hook 8 in the same manner as aperture 23 in the FIG. 5 device. The plug 16 can be attached to the tube 5" in the same manner discussed above with respect to the tube 5 and wand 6.

In FIG. 4 an actuator is shown for opening and closing vertical blinds composed of vertical slats 19. In this type of blind a rope or chain 18 is attached to the mechanism that operates the blinds. Spaced along the existing rope or chain are beads 20 that provide a gripping surface for the user. As the rope or chain is pulled in one direction the blind will be opened, while pulling in the other direction closes the blind. In the FIG. 4 embodiment the motor shaft 4' is connected to a wheel or pulley 17 which has a non-slip surface. The chain or rope 18 fits around the wheel and acts in the same manner as the shaft 4 in the FIG. 1 device. As the motor turns in one direction the blind opens, and when the motor turns in the other direction the blind closes.

Figure 7:
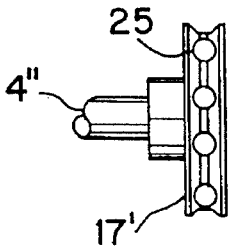
FIG. 7 shows a pulley with a bead pattern embossed on the pulley.
Figure 8:
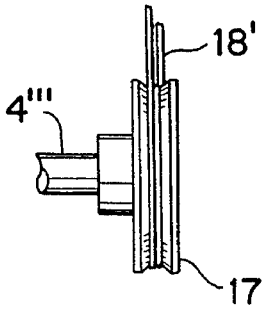
FIG. 8 shows a modified pulley that can be used with the FIG. 4 device.

FIG. 7 shows gear 17' which has depressions 25 in the groove in the pulley for receiving a chain or rope with beads. FIG. 8 shows another pulley 17" on a motor shaft 4'" that can be used with a rope that does not have beads 20. The pulley 17" has a U-shaped groove which has a non-slip surface. The rope 18' can be attached to the pulley by wrapping it several times around the pulley 17".

In all other respects the FIG. 4 embodiment is the same as the FIG. 1 embodiment. The motor housing 2' has a motor, gear train and limit switches similar to those in the FIG. 1 device, and they operate in substantially the same manner.

Figure 9:
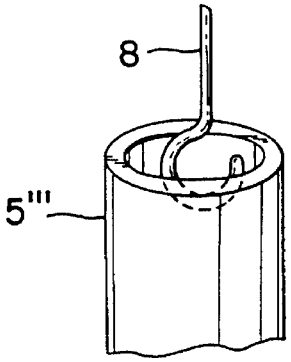
FIG. 9 shows another embodiment for attaching the tubing to the blind.

FIG. 9 shows another embodiment in which the tube 5'" is secured to the hook 8 by a friction fit between the inside of the tube and the outside of the hook. This embodiment could also use the heat shrink tube described above.

Figure 10:
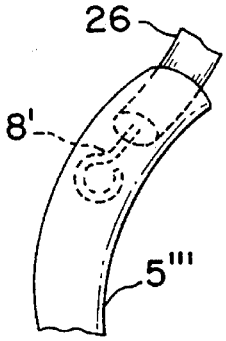
FIG. 10 shows another embodiment for attaching the tubing to the blind.

FIG. 10 shows another embodiment in which the tube 5'" is secured to a modified hook 8' which is attached to a stub 26 which is in turn attached to the mechanism that operates the blind.

Figure 11:
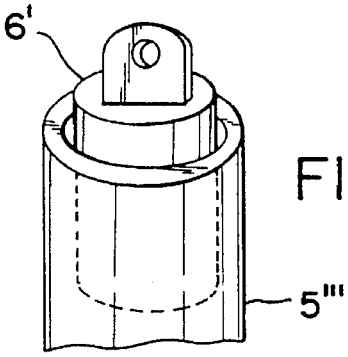
FIG. 11 shows a shortened or replacement wand inserted in the tubing.

FIG. 11 shows another embodiment in which the tube 5'" is secured to a shortened wand or replacement wand 6'.

Figure 12:
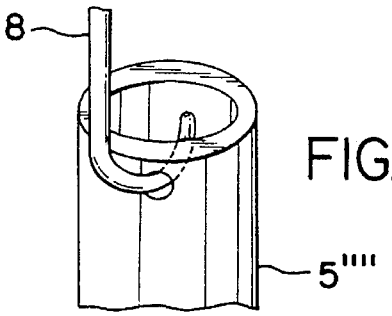
FIG. 12 is a view of an embodiment similar to the FIG. 5 embodiment with the hook passing through only one aperture.

FIG. 12 shows another embodiment in which the tube 5"" has only a single aperture which receives the hook 8.

Although the blind actuator and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. In a motorized window blind system having a motor with an output shaft adapted to be operatively attached to a mechanism means for opening and closing said window blind system, said motorized window blind system having adjustable limit switches to control the amount said window blind system is open or closed, a rigid shaft having a first end detachably attached to said mechanism means and a second end having means for detachably attaching said rigid shaft to said output shaft of said motor, said means for detachably attaching said rigid shaft to said output shaft of said motor comprising a hollow tube detachably connected at one end to said output shaft of said motor and detachably connected at an opposite end to said second end of said rigid shaft.

2. In a motorized window blind system as claimed in claim 1, wherein said hollow tube is attached to said output shaft of said motor and to said means for opening and closing said window blind system by means of a friction fit.

3. In a motorized window blind system as claimed in claim 1, wherein said hollow tube is made from a heat shrink material and is heat shrunk onto said output shaft of said motor and onto said means for opening and closing said window blind system.

4. In a motorized window blind system as claimed in claim 1, wherein said hollow tube has at least one aperture in its side and said means for opening and closing said window blind system is a hook which passes through said at least one aperture.

5. In a motorized window blind system as claimed in claim 1, wherein said hollow tube has a plug in one end, and said plug has at least one aperture and said means for opening and closing said window blind system is a hook which passes through said at least one aperture.

6. In a motorized window blind system as claimed in claim 1, wherein said means for opening and closing said window blind system is a hook and the inside diameter of said hollow tube is a friction fit with the outside diameter of said hook.

7. In a motorized window blind system having a motor with an output shaft operatively attached to means for opening and closing said window blind system, and said motorized window blind system having adjustable limit switches to control the amount said window blind system is open or closed, and wherein the means for opening and closing said window blind system comprises an endless loop of flexible material, the improvement comprising:

a wheel attached to said output shaft of said motor, and said endless loop of flexible material is attached to said wheel, said endless loop of flexible material has a plurality of protrusions spaced there along, thereby providing a portion of said endless loop between adjacent protrusions, said wheel has a series of apertures and slots which engage said endless loop of flexible material and said plurality of protrusions, when said endless loop is attached to said wheel, said protrusions engage said apertures, and said endless loop portion which is between adjacent protrusions engage said slots.

* * * * *